US005553398A

United States Patent [19]

Schnewlin-Maier

[11] Patent Number: 5,553,398

[45] Date of Patent: Sep. 10, 1996

[54] ELASTICALLY RESILIENT SHOE INSOLE HAVING A NUBBED SURFACE

[76] Inventor: Margrit Schnewlin-Maier, Hauptstrasse 68, CH-8437, Zurzach, Switzerland

[21] Appl. No.: 365,610

[22] Filed: Dec. 27, 1994

[51] Int. Cl.[6] ..... A43B 13/40

[52] U.S. Cl. ..... 36/43; 36/141

[58] Field of Search ..... 36/140, 141, 43, 36/44

[56] References Cited

U.S. PATENT DOCUMENTS

| | | | |
|---|---|---|---|
| 4,109,661 | 8/1978 | Fukuoka | 36/141 |
| 4,727,661 | 3/1988 | Kuhn | 36/43 X |

FOREIGN PATENT DOCUMENTS

| | | | |
|---|---|---|---|
| 2048240 | 2/1993 | Canada | 36/43 |
| 225285 | 11/1986 | European Pat. Off. . | |
| 1823203 | 12/1960 | Germany . | |
| 2619410 | 11/1976 | Germany | 36/141 |
| 8304272 | 10/1983 | Germany . | |
| 3330060 | 2/1985 | Germany | 36/43 |
| 3400049 | 7/1985 | Germany . | |
| 146149 | 11/1979 | Japan . | |
| 1299560 | 3/1987 | U.S.S.R. | 36/44 |
| 8504786 | 11/1985 | WIPO . | |
| 8603384 | 6/1986 | WIPO | 36/43 |
| 9113561 | 9/1991 | WIPO | 36/43 |

OTHER PUBLICATIONS

Pressure Point Insoles, Jan., 1991, only one page.

*Primary Examiner*—Ted Kavanaugh
*Attorney, Agent, or Firm*—Speckman, Pauley & Fejer

[57] ABSTRACT

An insole having a thin baseplate with a surface that is tightly nubbed. Breathing openings are disposed between the nubs. Magnetic heads are fastened, preferably releasably, on the baseplate. The baseplate is thickened in the area of the magnetic heads. This thickened area has a surface which is not nubbed. The thickening is preferably drawn to at least the level of the tips of the nubs. Such an insole, which only has a total thickness of approximately 3 mm, can be worn in all commercially available shoes and boots. The insole can also be employed particularly advantageously in athletic shoes.

4 Claims, 1 Drawing Sheet

ELASTICALLY RESILIENT SHOE INSOLE HAVING A NUBBED SURFACE

BACKGROUND OF THE INVENTION

1. Field of the Invention

This invention relates to an insole for shoes, having an elastically resilient material with a largely nubbly surface and with at least one magnetized metallic magnetic head connected with the insole.

2. Description of Prior Art

Insoles of the above-mentioned type have been commercially available for many years in many embodiments. Particular reference is made to an insole taught by European Patent Publication EP-A-0 225 285. This insole has a relatively thick baseplate with a largely closely nubbed surface. The nubs are of different height and in this way form an appropriate foot support. The nub height varies between 4 and 14 mm. Insoles of the previously mentioned type require special shoes which offer sufficient space for the thickness, which is considerably increased with respect to simple insoles. There is an effective massaging effect with such insoles.

Magnetized metallic pressure heads, which are known in connection with such insoles and which are applied in accordance with the teachings of acupuncture at important places in particular, cannot be easily integrated in a relatively thin insole. If these pressure heads project too far beyond the insole, they do not perform their intended function, but rather cause pain.

If the nub formation of such insoles is reduced, this also reduces the air circulation between the baseplate and the foot. This results in increased perspiration.

An insole of the above-described type is known from International Patent Publication WO-A-85/04786 which, avoids an increase in the height of the shoes, with a sole having an appropriate depression. The insole accordingly cannot be used for a normal, commercially available shoe. Furthermore, German Utility Model DE-U-83 04 272 discloses an insole, having a baseplate with a plurality of tubular rivets extend, the rivet heads having the shape of nubs. These nubs are not flexible and accordingly must be designed very flat in order not to cause pain. Thus, there is an acupuncture pressure effect, but the massage effect of the nubs is lost. Also, the breathing openings are located in the center of the tubular rivets, which are exactly covered with increased pressure by the sole of the foot.

However, because of this the desired air circulation is prevented to a large extent. Since, in addition, the rivet heads must be relatively flat, an air cushion cannot be formed between the individual nubs. A dense disposition of the nubs is furthermore impossible, since the baseplate would otherwise become completely inflexible.

German Patent Publication DE-U-18 23 203 teaches a flat baseplate with tubular rivets inserted therein. But no nub-shaped rises are disclosed. The effects of such an insole remain unclear. German Patent Publication DE-A-34 00 049 discloses a double-layered baseplate which is kept together by tubular rivets and to whose underside activated charcoal has been applied, which is intended to catch the odor and absorb the perspiration from the feet. The tubular rivets themselves are constructed of copper. Finally, Japanese Patent Publication JP-A-54 146149 discloses an insole having magnetized metal heads.

Neither this reference, nor any of the previously cited references, which employ tubular rivets, disclose an insole with a tightly nubbed surface.

SUMMARY OF THE INVENTION

It is therefore one object of this invention to provide an insole of the previously mentioned type which is as flat as possible and which can be inserted into all commercially sold shoes without the user suffering disadvantages in wearing comfort.

This object is attained by means of the instant invention with an insole having an elastically resilient material with a nubbly surface and at least one magnetized metallic magnetic head connected with the insole. A baseplate has a maximum thickness of up to about 1.5 mm and a height of the nubs is of equal size, up to about 2 mm. A cross-sectional shape of the nubs is approximately triangular. A plurality of breathing openings are positioned in the baseplate next to the nubs. The baseplate has no nubs in an area around the pressure heads, but has an increased thickness in such area so that the baseplate has at least approximately a height of the surrounding nubs. Further advantageous embodiments of this invention are apparent from the following description.

One preferred embodiment of this invention is represented in the attached drawings and explained by the subsequent description.

DESCRIPTION OF PREFERRED EMBODIMENTS

Figures 1, 2, 3:
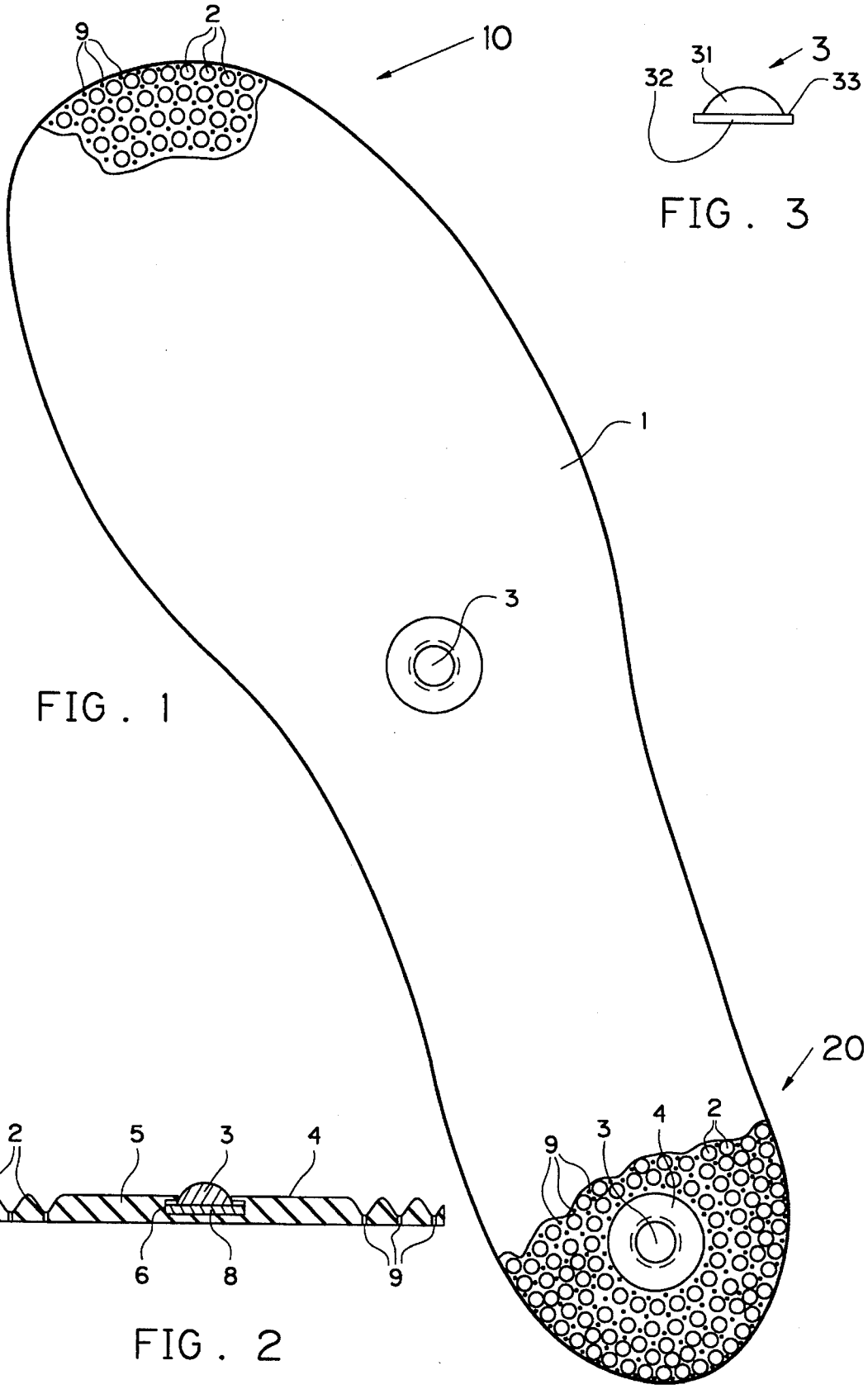
FIG. 1 shows a front view of an insole in actual size with a partial view of a nubbed surface.
FIG. 2 shows a cross section taken through an insole in an area of a magnetized magnetic head, on a slightly enlarged scale.
FIG. 3 shows a magnetic head, as shown in FIG. 2.

The baseplate of the insole is identified by element reference numeral 1. On its surface it is covered almost completely with nubs 2 adjoining each other relatively closely. For the sake of simplicity, only an area 10 around the toes and an area 20 at the heel is shown as being nubbed. However, the nubs 2 almost completely cover the surface of the baseplate 1. Only two magnetic heads 3 are shown in the embodiment of FIG. 1.

One magnetic head 3 is located in the heel area 20 and the other in the area between the heel area 20 and the toe area 10. In an advantageous manner, a magnetic head is placed in the area which, in accordance with the teachings of acupuncture, acts on the vegetative nervous system and therefore stimulates the internal organs. It is of course also possible to dispose additional magnetic heads 3 about baseplate 1.

A circular court 4, which is free of nubs, is located around each magnetic head 3. The diameter of the nub-free court 4 is about 2 to about 3 cm, however preferably about 2.5 cm. This size has been particularly proven since in this way a sufficiently large surface for taking up pressure is provided but, on the other hand, the size does not result in an increased perspiration output. The baseplate 1 is thickened in the area of the court 4. This thickening 5 is of such a size that it approximately corresponds to the height of the baseplate 1 plus the nub 2. In other words, the baseplate 1 is drawn to the level of the nubs 2 in the area of the thickening 5. The magnetic head 3 is centrally disposed in the thickening 5. It can be directly vulcanized or injection molded into the insole, for example, or can be releasably connected therewith. The latter case is illustrated in connection with the preferred embodiment. It is accomplished by placing a pocket-shaped receiving opening 6 in the thickening 5.

The magnetic head 3 represented by itself in FIG. 3, is designed to be dynamically balanced. It has a lens-shaped rise 31 and a foot plate 32 connected therewith in one piece, whose diameter is larger than the diameter of the lens-shaped rise 31. In this way a lateral circumferential collar 33 projects outward. The magnetic head 3 can be buttoned into the pocket-shaped receiving opening 6 by means of this collar 33. The releasable connection of the magnetic heads 3 with the insole is preferred, since in this way they can be removed from the insole and the insole itself can be cleaned, for example in a washing machine, without the pressure magnetic heads 3 being damaged thereby.

A multitude of breathing openings 9 are disposed between the nubs 2 in the baseplate 1. In this way it is assured that the breathing openings 9 are not closed off by the sole of the foot of the user. In one preferred embodiment, at least the same number of breathing openings will be provided as there are nubs 2. But the breathing activity is increased if a plurality of breathing openings 9 are disposed around each nub 2. The size of the breathing openings 9 are preferably such that they cannot be pushed closed by the pressure of the user on the insole, which causes the compression of the nubs 2 and the baseplate 1.

It is advantageous to make the depth of the pocket-shaped receiving openings 6 greater than the thickness of the foot plate 32 of the magnetic heads 3. In this way a space remains under the foot plate 32 when installed, which can be filled with a padding material 8. Preferably, the padding material 8 is of lesser hardness than the material of the baseplate 1 and the nubs 2. This results in increased compressibility.

Another preferred embodiment of this invention is especially advantageous for athletic shoes. During running and jumping in particular, considerable pressures occur over a short period of time in the area of the heel, which can result in pain in the area of the pressure magnetic heads 3 if the latter cannot get out of the way sufficiently.

Tests have shown that the insole in accordance with this invention can be inserted without problems into all commercially available shoes and sandals, boots and hiking boots, as well as athletic shoes. The low total height of the insole of this invention also permits its use in elegant ladies' shoes, for example. In spite of the considerably reduced total thickness of the insole, the desired effect, namely massaging and acupuncture pressure, is completely retained. The improved air circulation reduces perspiration.

So that in spite of their considerably reduced height the nubs 2 still have a sufficient massage effect, it is advantageous for the nubs 2 to have an approximately cone-shape or triangular cross section. One the one hand, this increases the air circulation spaces and, on the other, the specific pressure in the contact area is increased in this way.

Because the baseplate 1 is of a thickness of only up to about 1.5 mm in the nubbed area and the nub 2 height is up to about 2 mm, the total thickness of the insole is low enough so that it can actually be worn in any type of shoe. So that the thin baseplate 1 still has sufficient strength, it is possible to embed the plate, which is preferably of plastic or vulcanized rubber, into a textile fabric for strengthening.

What is claimed is:

1. An improved insole for shoes, having an elastically resilient material with a nubbly surface, at least one metallic magnetic head (3) connected with the insole, the improvement comprising: a baseplate (1) having a maximum thickness of up to about 1.5 mm in a hubbed area, a nub height of each of a plurality of hubs (2) of approximately equal size and up to approximately 2 mm, an overall shape of each of the hubs (2) being approximately cone-shaped, the baseplate (1) having a plurality of breathing openings (9) positioned next to the nubs (2), the baseplate (1) having a nub-free thickened area (4) around each of the at least one metallic magnetic head (3) such that the baseplate (1) approximately attains the nub height of the surrounding hubs (2); and the at least one metallic magnetic head (3) releasably connected with the baseplate (1), the baseplate (1) having a plurality of pocket-shaped receiving openings (6), each of the at least one metallic magnetic head (3) having a widened collar (33) mounted in one of said pocket-shaped receiving openings (6), and a padding material (8) positioned under the at least one metallic magnetic head (3) when mounted in said one of said pocket-shaped receiving openings (6).

2. An insole in accordance with claim 1, wherein the nub-free thickened area (4) surrounding the at least one metallic magnetic head (3) is circular and has a diameter of about 2 to 3 cm.

3. An insole in accordance with claim 1, wherein each of the nubs (2) is surrounded by several of the breathing openings (9).

4. An insole in accordance with claim 1, wherein a thickness of the baseplate (1) in an area of the nubs (2) is less than about 1 mm.

* * * * *